US006225566B1

(12) United States Patent
Dienst

(10) Patent No.: US 6,225,566 B1
(45) Date of Patent: May 1, 2001

(54) SELF-RETAINING SCREW SPACER ARRANGEMENT

(75) Inventor: Richard L. Dienst, Mission Viejo, CA (US)

(73) Assignee: Bivar, Irvine, CA (US)

( * ) Notice: Subject to any disclaimer, the term of this patent is extended or adjusted under 35 U.S.C. 154(b) by 0 days.

(21) Appl. No.: 09/253,961

(22) Filed: Feb. 22, 1999

(51) Int. Cl.[7] ..... H01B 17/00

(52) U.S. Cl. ..... 174/138 E; 174/138 D; 361/742; 361/758; 361/770; 428/34.1; 411/546

(58) Field of Search ..... 174/138 D, 138 E, 174/138 G, 165, 166 R, 166 S, 167, 168; 361/742, 758, 770, 804, 807, 809; 428/34.1; 403/24; 411/542, 546

(56) References Cited

U.S. PATENT DOCUMENTS

| | | | | |
|---|---|---|---|---|
| 2,395,785 | * | 2/1946 | Klingler et al. | 174/138 E |
| 2,681,378 | * | 6/1954 | Skwarek | 174/138 D |
| 2,936,015 | * | 5/1960 | Rapata | 174/138 D |
| 3,362,276 | * | 1/1968 | Gould | 411/542 |
| 4,640,639 | * | 2/1987 | Matsui | 174/138 D |
| 4,975,008 | * | 12/1990 | Wagner | 411/542 |

* cited by examiner

*Primary Examiner*—Kristine Kincaid
*Assistant Examiner*—Adolfo Nino
(74) *Attorney, Agent, or Firm*—Harold L. Jackson

(57) ABSTRACT

A screw retaining spacer includes an outer rigid plastic core and a softer elastic inner core defining a through-hole. The inner core has a plurality of ridges that resiliently grasp the shaft of a screw inserted into the through-hole. Accordingly, screws assembled with these spacers remain assembled. The spacer can be standardized and inventoried in large quantities to meet a variety of screw sizes and tolerance.

20 Claims, 5 Drawing Sheets

SELF-RETAINING SCREW SPACER ARRANGEMENT

BACKGROUND OF THE INVENTION

1. Field of the Invention

This invention relates generally to spacer arrangements, and more particularly, it is directed to spacers for mounting printed circuit boards, discrete components, fans, etc. and method of making the same.

2. Description of the Prior Art

Electronic devices are present in modern equipment from telecommunications to advanced avionics to medical industries. Society has become accustomed to more innovative and sophisticated electronic products, year after year, and advancements in these products have become common place. Such products or devices may have hundreds or even thousands of electrical components mounted on electronic circuit boards. While each circuit board can accommodate a large number of electronic components such as transistors, semiconductor chips, resistors, capacitors, for example, as more functionality is added to electronic assemblies, several circuit boards may be needed to provide the necessary circuitry for the particular electronic product. In such cases, multiple circuit boards are typically mounted together in a stacked arrangement, one board on top of the other. In addition, there is a need to mount accessory items such as descrete devices, cooling fans etc. on a supporting structure within a cabinet.

Conventional spacers, such as the tubular spacer 12 shown in FIG. 1 may be used to structurally separate stacked circuit boards or to mount accessory items on a supporting surface. The conventional spacer 12 has a cylindrical shaped body with a bore 14 therethrough and is typically made from a hard plastic material, such as nylon. It comes in a variety of heights to provide the desired amount of board separation. Conventional spacers also readily slide on and off the shaft of a screw. While conventional spacers provide good structural separation support, they are not assembler friendly, as they easily slide off the screw they have been mated with, prior to or during the assembly process. Production time is therefore wasted and the cost of assembling an electronic product increases. When hundreds or thousands of products are being assembled, the increased production can be significant. With the ever-present pressure to drive costs down in order to be competitive in the consumer electronic market other spacers have evolved.

One such spacer is illustrated in FIG. 2, in which a screw spacer 16 includes a ribbed inner wall 18. A screw inserted into the spacer is held therein by the ribs. However, in order to provide the spacer with sufficient rigidity to provide the necessary mechanical separation support, this spacer 16 as with the conventional spacer described above, must be made of hard plastic material. Accordingly, while spacer 16 provides an improvement over the above-described conventional spacers, screws with a wide range of thread diameter tolerances may either be difficult to insert into spacer 16 or slip out of the spacer altogether. As such, there is still a need for a versatile spacer that provides a dependable solution for quick mechanical assembly and reduced assembly time that is simple to manufacture in large quantities. Additionally, it may be desirable to have a spacer arrangement that accommodates a variety of screws with different thread sizes.

SUMMARY OF THE INVENTION

The foregoing mentioned disadvantages are avoided by a spacer made of two different materials, including an outer sleeve portion made of a rigid material and an inner sleeve portion made of softer material. The through-hole of the softer inner sleeve portion is sized to resiliently accept and snugly hold the shaft of a screw inserted therein.

In one preferred embodiment of the spacer, the softer inner sleeve portion through-hole has a plurality of ridges that extend inwardly to resiliently grasp the shaft portion of a screw. The ridges of the softer inner sleeve portion provide a snug fit to the screw with a low insertion force. This allows spacers to be presassembled with screw and remain mated together during handling and assembly. In another preferred embodiment, the outer sleeve portion has a plurality of inwardly projecting ridges and the softer inner sleeve is disposed over the inner surface of the outer sleeve including these ridges. The soft inner sleeve portion disposed on the ridges resiliently holds a screw shaft inserted through the spacer. In both these spacer embodiments, the outer sleeve portion provides the rigid structure of the spacer providing for mechanical separation.

The relative simplicity of these spacer arrangements allows the spacers to be made in large quantities, being suitably adaptable for the variety of screw sizes, tolerances and/or configurations.

The construction and operation of the preferred embodiments of the spacer of the present invention may best be understood by reference to the following description taken in conjunction with the accompanying drawings in which like components are designated by the same primed reference numbers.

DESCRIPTION OF THE PREFERRED EMBODIMENTS

Figure 1:
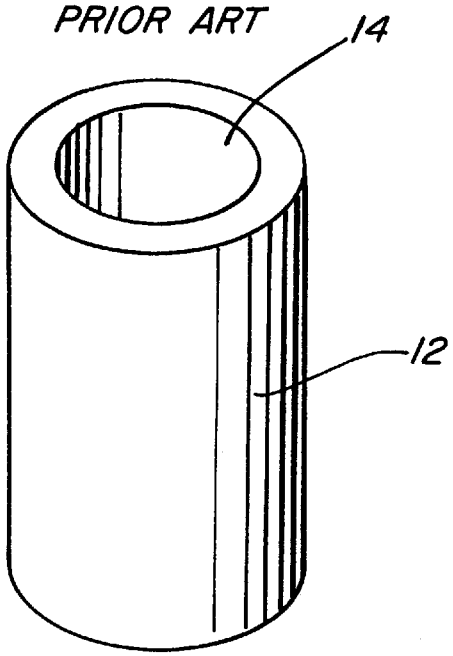
FIG. 1 PRIOR ART
FIG. 1 is a perspective view of a conventional prior art spacer.
Figure 2:
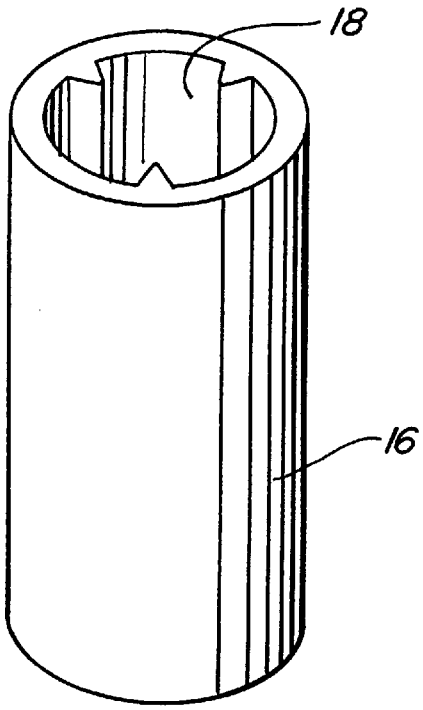
FIG. 2 PRIOR ART
FIG. 2 is a perspective view of another prior art spacer.
Figure 3:
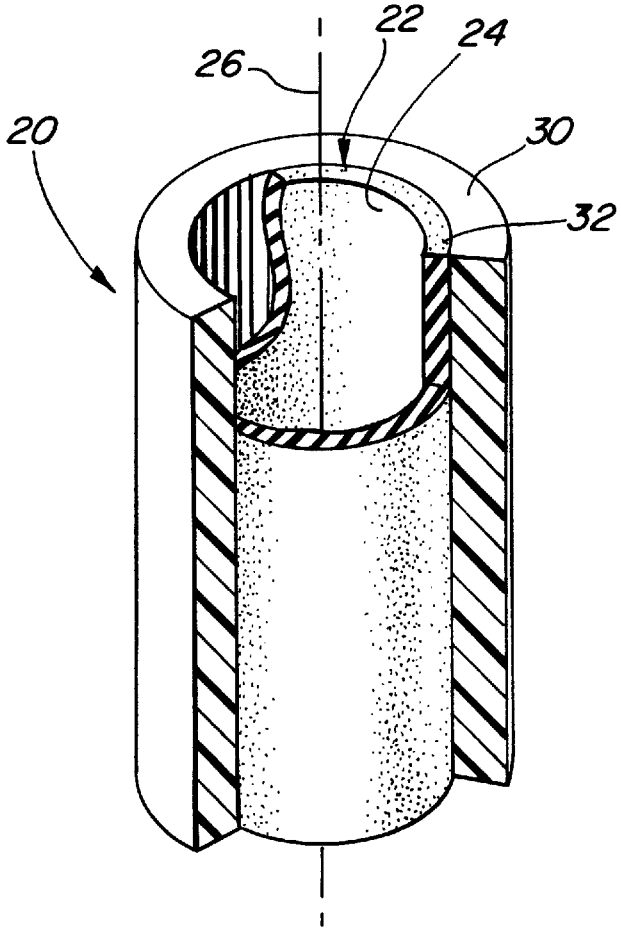
FIG. 3 is a perspective view partially broken away of a screw retaining spacer illustrating the unitary outer and inner core structure in accordance with the principles of the inventions.
Figure 4:
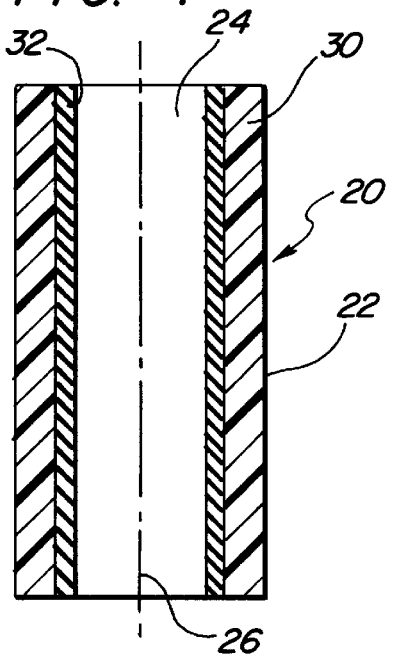
FIG. 4 is a cross-sectional side view of the spacer of FIG. 3.
Figure 5:
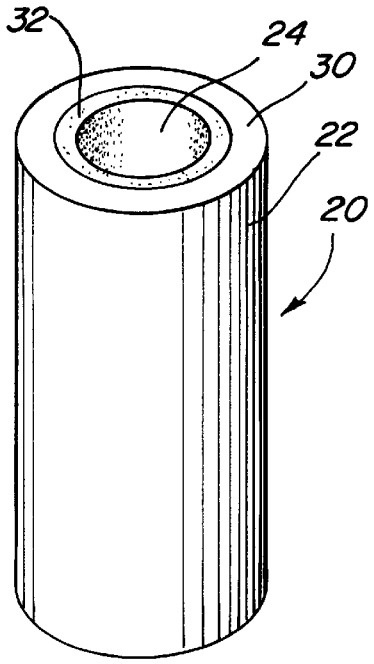
FIG. 5 is a perspective view of the spacer shown in FIG. 4.

Referring now to the drawings and more particularity to FIGS. 4 and 5 there is shown a spacer 20 in the form of a cylindrically shaped sleeve 22 having a through-hole 24 which defines a longitudinal axis 26. The cylindrically shaped sleeve 22 has an outer core portion 30 and an inner core portion 32. The outer core portion 30 is tubularly shaped and made of a rigid material such a hard plastic material that can withstand axially compressive forces, thereby providing the spacer with its mechanical functionality.

The inner core portion 32 also is tubularly shaped but made of a semirigid or softer material, such as a resilient elastic material. The through-hole 24 of the inner core portion has a diameter that is slightly less than the diameter of threaded screw shafts. Additionally, the softer material of the inner core portion is selected to provide a low insertion force for a variety of screw tolerances or even screw sizes but also provide a resilient fit about the shaft of the screw. By appropriately selecting the size of the through-hole and the material for the inner core, the spacer will remain on the screw once inserted therein. In its broadest sense, the spacer according to the principles of this invention comprises this simple yet novel inner and outer core spacer arrangement.

Figure 6:
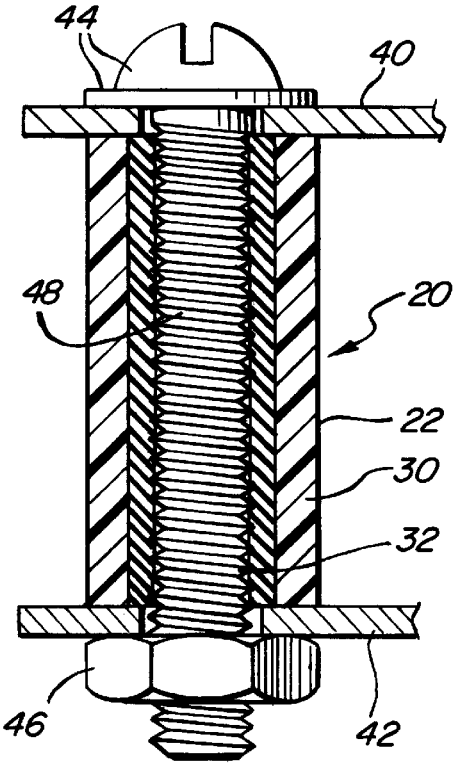
FIG. 6 is a cross-sectional side view of the spacer showing the inner core griping the threaded shaft of a screw.

FIG. 6 illustrates spacer 20 separating two circuit boards 40 and 42. Screw 44 extends through the two circuit boards 40, 42 and spacer 20, coupling these elements together with nut 46 threaded on the end of the screw shaft 48. The inner core portion 32 of the spacer 20 resiliently engages the threads of shaft 48 of the screw 44. The outer core portion 30 maintains the two circuit boards in the desired spaced relationship.

Figure 7:
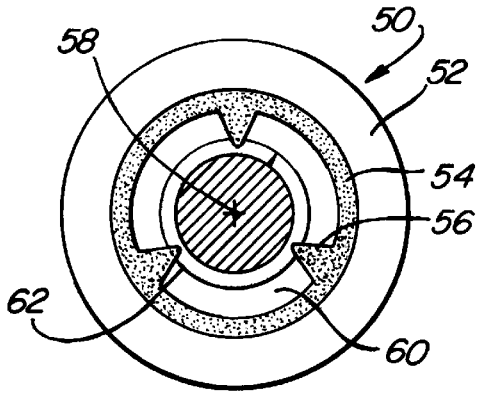
FIG. 7 is an end view of a preferred embodiments of a screw retaining spacer.
Figure 8:
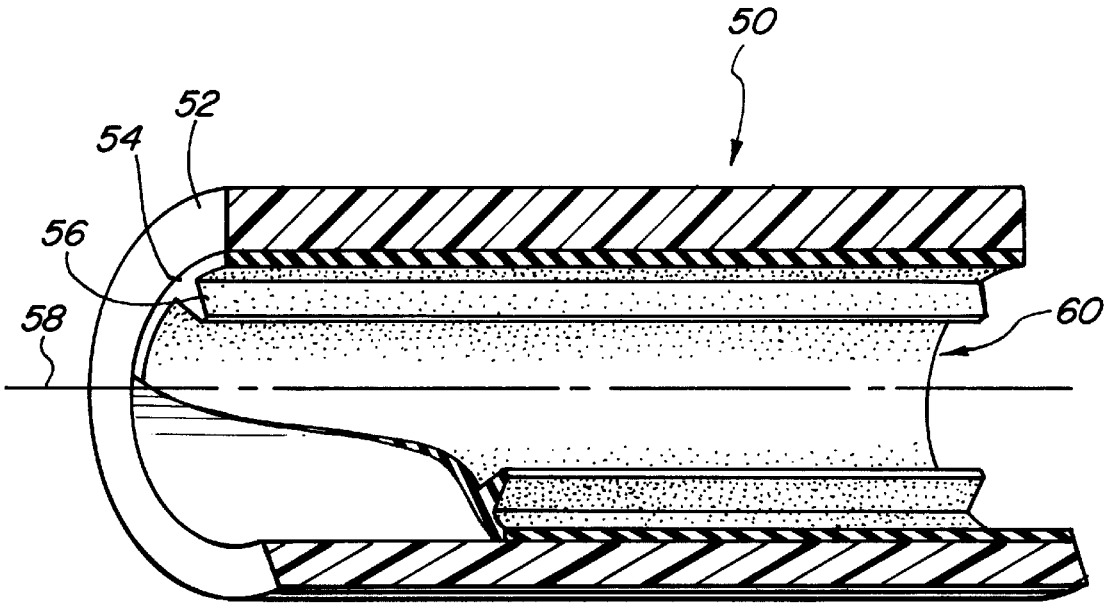
FIG. 8 is a partially broken away perspective view of the screw retaining spacer shown in FIG. 7.

In order to accomplish this screw shaft gripping function more readily, the inner core portion through-hole may have a plurality of protrusions thereon. In accordance with a preferred embodiment of this invention, spacer 50 (FIG. 7) has an outer core portion 52 and an inner core portion 54 in which such protrusions may comprise elongated ridges 56. The elongated ridges 56 are disposed parallel to longitudinal axis 58 and extend the length of the through-hole 60 as depicted with more particularity in FIGS. 7 and 8. Additionally, the elongated ridges 56 may be disposed in an equally spaced relationship about the through-hole 60 which centers a screw shaft inserted through the spacer. In this preferred embodiment three elongated ridges 56 are shown directed inwardly toward the longitudinal axis 58. These ridges resiliently grasp the shaft 62 of a screw inserted into the spacer to hold the shaft snugly therein (shown in FIG. 7).

Figure 9:
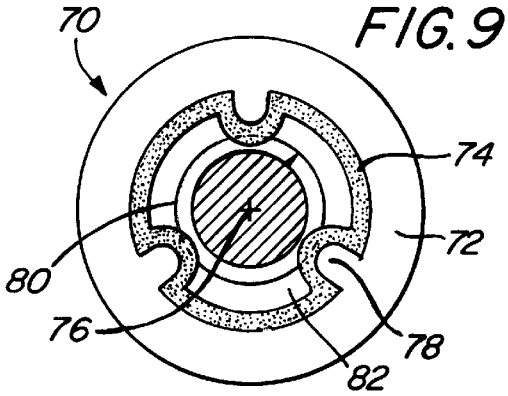
FIG. 9 is an end view of another preferred embodiment of screw retaining spacer.
Figure 10:
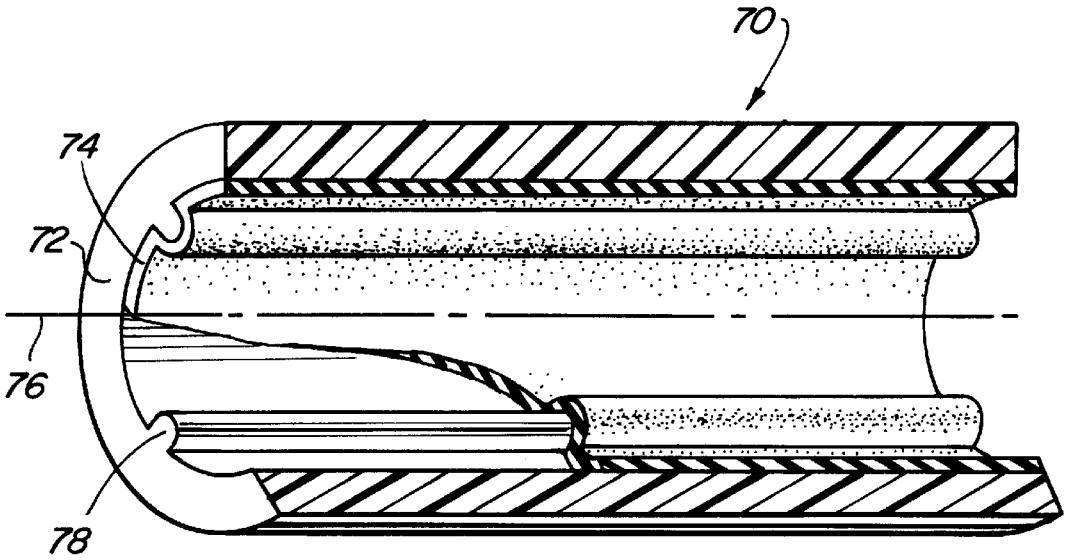
FIG. 10 is a partially broken away perspective view of the screw retaining spacer shown in FIG. 9.

In another preferred embodiment, shown with more particularity in FIGS. 9 and 10, a spacer 70 in the form of a sleeve includes a rigid outer core portion 72 and a softer inner core portion 74, together defining a longitudinal axis 76. The outer core portion 72 has a plurality of ridges thereon which preferably comprise elongated ridges 78 extending parallel to the longitudinal axis 76 of the sleeve. The inner core portion 74 comprises a softer thin layer adjacently disposed within the outer sleeve 72 including the ridges 78. This inner core portion 74 provides the means to resiliently grasp a screw shaft 80 inserted within the through-hole 82 of the spacer 70.

Any of the above described dual core spacers, can accommodate a variety of screw sizes with varying tolerances by appropriately selecting the diameter of the through-hole, number and size of the protrusions or ridges and the softness of the material for the inner core. In order to provide a spacer that can withstand axial compressive forces yet have the flexiblity to hold screws, the outer core portion may preferably be made of rigid PVC material, selected to have a hardness in the range of about 60 to 90 shore D hardness of preferably about 75D shore hardness. The inner core portion may preferably be made of a less rigid or semirigid PVC material selected to have a hardness of within the range of about 60 to 90 shore A hardness and preferably about 75 shore A hardness. PVC (polyvinyl chloride) has a high dielectric characteristic i.e., is a nonconductor of electricity.

The spacer is preferably made using a co-extrusion process for manufacturing an integral structure with the construct of two different plastic materials. Such a technique employs a single die to form individual layers within the die and combine two layers before they exit the die, so that the co-extruded structure exists as an integral construction from the die. Alternatively, the individual layers of plastic can be isolated from each other until they exit the die and then after exiting while still molten combined to form the integral tubular structure. While two different plastic materials are used in forming the spacer, the extruding process yields a unitary structure of uniform color, such as white for example. These co-extrusion methods advantageously, provide a simple, low cost, versatile manufacture of large quantities of spacers.

Figure 12:
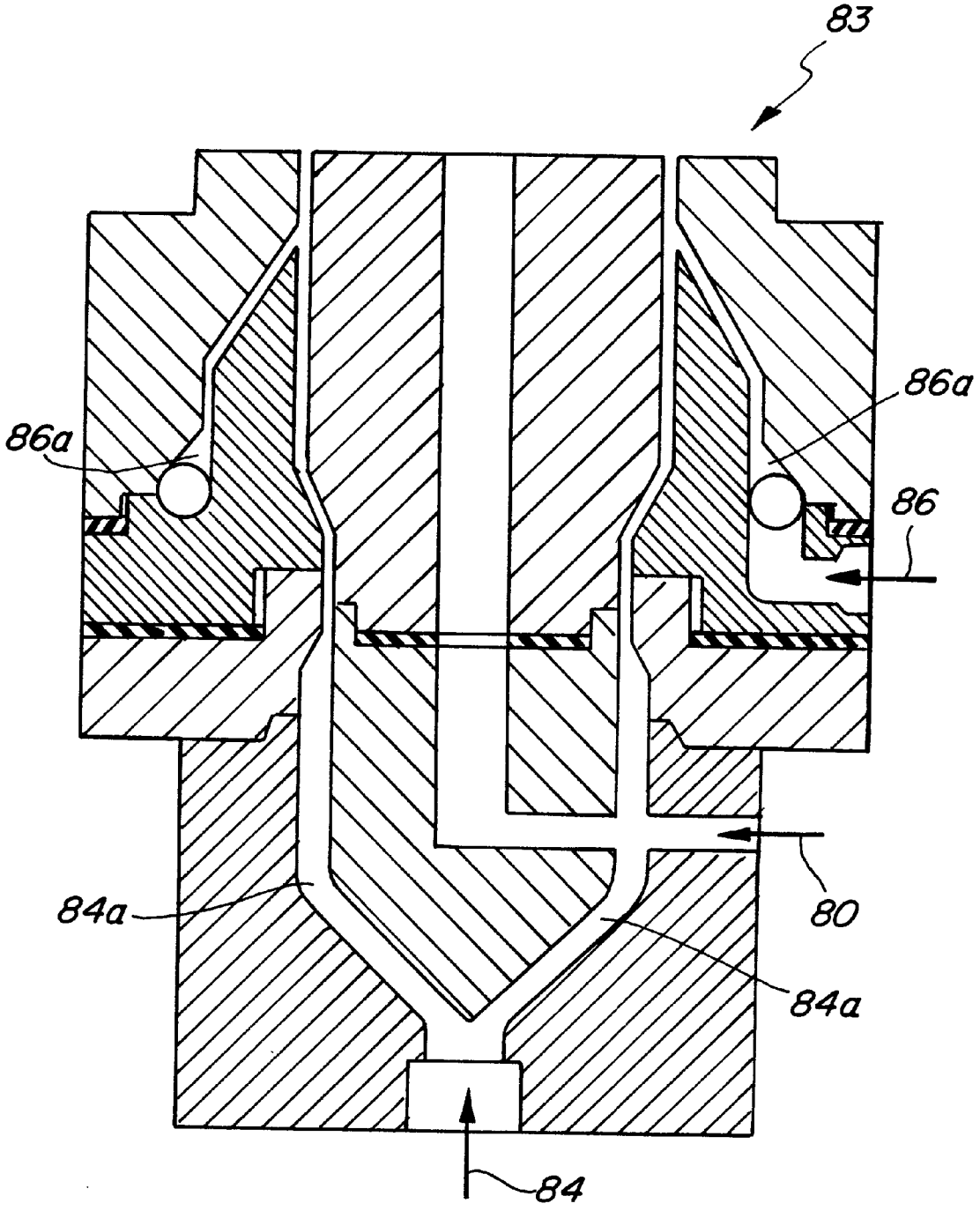
FIG. 12 is a cross-sectional view of an exemplary extrusion die for making tubular products.

An example of a conventional co-extrusion die 83 for making tubular products such as the spacer 20 of the present invention is illustrated in FIG. 12, which depicts a multiple manifold extrusion technique. Two inlet ports are provided: a first inlet port 84 for the inner resin and a second inlet port 86 for the outer resin. Each inlet port leads to a separate manifold 84*a*, and 86*a* respectively, for forming the individual layers of the tubular structure. These layers are combined at or close to the final land of the die and emerge as an integral construction. Air blown into the air inlet port 88 along with temperature and extrusion speed provides controlling factors in forming the dual core spacer structure in a well known manner.

Figure 11:
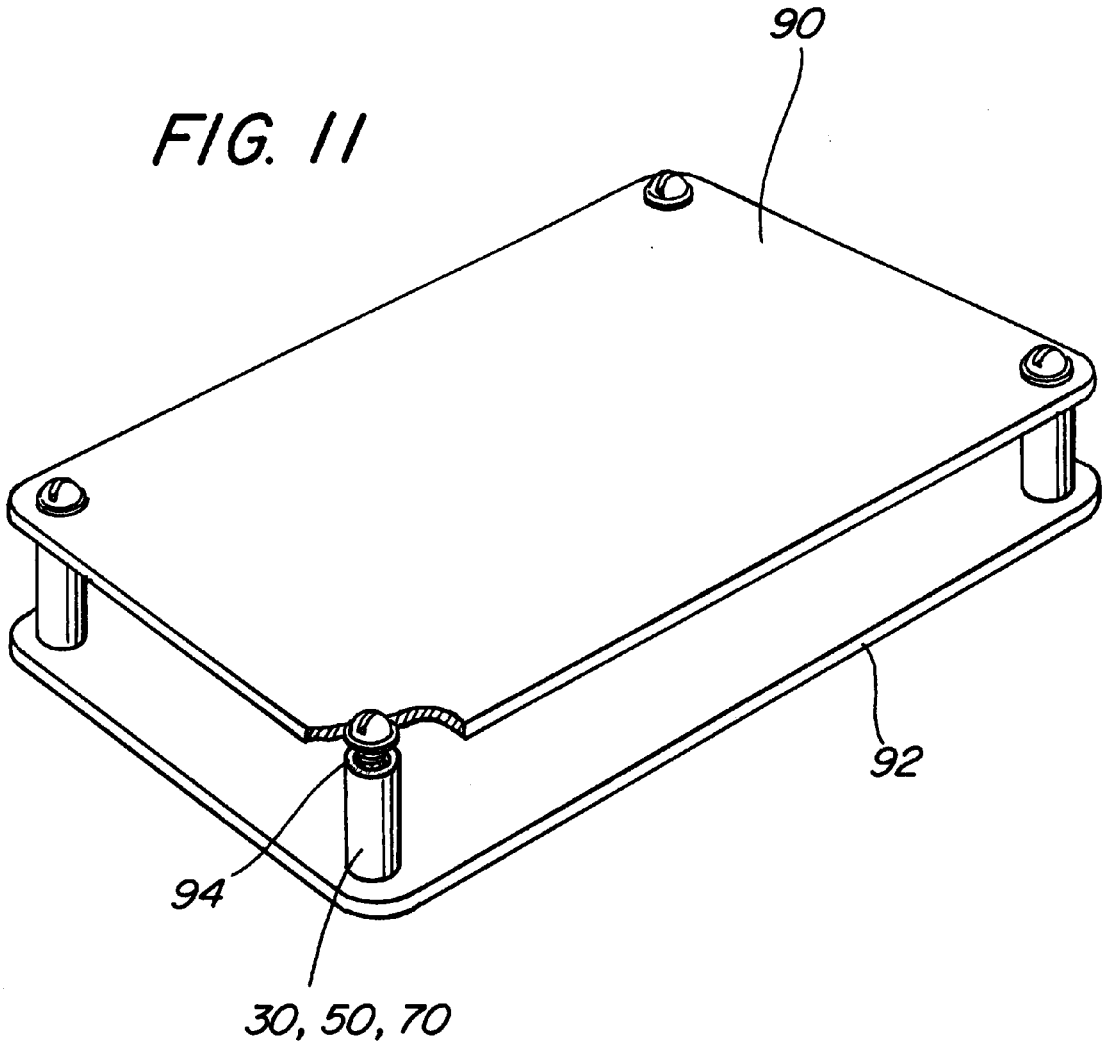
FIG. 11 is a perspective view of multiple printed circuit boards assembled together in a stacked arrangement using spacers of the present invention.

The self-retaining screw spacer of the present invention has many uses as noted previously. As one example, a multi-board electronic assembly can be built up using a number of the dual core spacers with conventional screws and nuts. As shown in FIG. 11, a perspective view of a two board assembly is illustrated with four dual core spacers, such as spacers 30, 50 or 70, used to stack and separate two printed circuit boards (PC boards) 90 and 92. Screws 94 inserted though holes in first PC card 90 and then the dual core spacers are held in place via there inner core portion while second PC card 92 is fastened against the dual core spacers via nuts (not shown) threaded onto the screws 94. The PC card stacked arrangement is thus held in rigid spaced alignment with the outer core of the spacers providing mechanical separation of the PC boards.

There has thus been described an improved spacer which can be reliably preassembled on a repetitive basis with screws and will remain assembled during handling and assembly of multiple circuit board structures or other electro-mechanical arrangements. Large quantities of the spacers can be readily manufactured. Thus, large customer demands for product can be met quickly and reliably. Advantageously, one dual core spacer can be used with screws having a wide range of thread diameter tolerances. The spacer can be inventoried in mass quantities being suitable to meet a variety of customer demands. Accordingly, various modifications of the spacer, and processes involved in manufacturing the connector spacer will occur to persons skilled in the art without involving any departure from the spirit and scope of the invention as set forth in the appended claims.

What is claimed is:

1. A spacer for retaining a screw therein, comprising:

an outer sleeve having a first hardness; and an inner sleeve having a second hardness softer than the outer sleeve, the inner sleeve having a hole therethrough for receiving the screw such that the inner sleeve resiliently grasps the screw thereby retaining it therein, the inner and outer sleeves being formed of an electrically nonconductive material.

2. The spacer defined in claim 1 wherein the inner sleeve has a plurality of inwardly projecting protrusions.

3. The spacer defined in claim 2 wherein the inwardly projecting protrusions comprise elongated ridges.

4. The spacer defined in claim 3 wherein the elongated ridges are substantially parallel arranged in an equally spaced apart relationship.

5. The spacer defined in claim 1 wherein the outer sleeve has plurality of inwardly projecting protrusions under the inner sleeve.

6. The spacer defined in claim 5 wherein the outer sleeve inwardly projecting protrusions comprise elongated ridges.

7. The spacer defined in claim 6 wherein the elongated ridges are parallelly arranged in an equally spaced apart relationship.

8. The spacer defined in claim 1 wherein the inner and outer sleeves are made of PVC plastic.

9. The spacer defined in claim 8 wherein the inner core has a hardness of 80 to 85 shore hardness A.

10. The spacer defined in claim 8 wherein the outer sleeve has a hardness of about 60D short.

11. A spacer for retaining a screw therein, comprising:

a nonconductive tubularly shaped member having an outer core portion having a first hardness and an inner core portion having a second hardness softer than the first hardness, the inner core portion defining a hole therethrough having a longitudinal axis and further defining a means for holding the screw.

12. The spacer of claim 11 wherein the means for holding the screw comprises a plurality of semirigid gripping elements.

13. The spacer of claim 12 wherein the semirigid gripping elements are inwardly disposed protrusions.

14. The spacer of claim 13 wherein the protrusions are three equally spaced elongated ridges extending substantially parallel to the longitudinal axis.

15. The spacer of claim 13 wherein the semirigid gripping elements are made of a semirigid plastic material.

16. The spacer of claim 15 wherein the semirigid plastic material has about an 80 to 85 shore A hardness.

17. A spacer having a hole therein through which a screw may be inserted to mount electrical components on a supporting surface comprising:

a tubular member having outer and inner core portions, each portion being made of an electrically nonconducting material with the outer core material being rigid and capable of withstanding axially compressive forces and the inner core material being less rigid and softer than the outer core portion to resistently grip the threads of a screw inserted therein.

18. The spacer of claim 17 wherein the inner and outer core portions comprise a plastic material.

19. The spacer of claim 18 wherein the inner core portion includes a plurality of inwardly projecting ribs.

20. The spacer of claim 18 wherein the plastic material of each core portion is PVC.

* * * * *